US010328552B2

(12) United States Patent
Forseth

(10) Patent No.: US 10,328,552 B2
(45) Date of Patent: Jun. 25, 2019

(54) WOOD CLAMP WITH LATERAL SUPPORT MEMBER

(71) Applicant: Chris F. Forseth, Kalispell, MT (US)

(72) Inventor: Chris F. Forseth, Kalispell, MT (US)

( * ) Notice: Subject to any disclaimer, the term of this patent is extended or adjusted under 35 U.S.C. 154(b) by 138 days.

(21) Appl. No.: 15/633,559

(22) Filed: Jun. 26, 2017

(65) Prior Publication Data

US 2018/0369995 A1 Dec. 27, 2018

(51) Int. Cl.
*B25B 7/02* (2006.01)
*B25B 7/12* (2006.01)
*B25B 5/14* (2006.01)

(52) U.S. Cl.
CPC ..... *B25B 7/02* (2013.01); *B25B 5/142* (2013.01); *B25B 7/123* (2013.01)

(58) Field of Classification Search
CPC .. B25B 5/04; B25B 5/06; B25B 5/145; B25B 5/16; B25B 5/163; B25B 5/166; B25B 7/00; B25B 7/02; B25B 7/04; B25B 7/14; B25B 7/16; B25B 7/123
USPC ..... 81/342, 352, 353, 354, 356, 367, 368, 81/369, 370, 371; 269/3, 6, 41–43, 87.1, 269/87.2, 95, 96, 170, 904
See application file for complete search history.

(56) References Cited

U.S. PATENT DOCUMENTS 1,883,081 A 10/1928 Sturm
3,083,007 A 3/1963 Campfield
3,181,181 A 5/1965 Buckley et al.
3,314,319 A 4/1967 Schmidt
4,386,543 A * 6/1983 Walker, Jr. ..... B25B 7/02 269/265
4,505,011 A * 3/1985 Dupuy ..... A62B 35/04 24/132 R
4,696,460 A 9/1987 Genereaux et al.
4,747,588 A * 5/1988 Dillhoff ..... B25B 5/12 269/258
5,165,642 A 11/1992 Rihaly
5,575,518 A * 11/1996 Payne ..... B25B 7/00 269/41
5,873,568 A * 2/1999 Mayfield ..... B25B 7/22 269/3
6,155,547 A * 12/2000 Gatanas ..... B25B 5/12 269/41
6,431,533 B1 * 8/2002 Jesperson ..... B65G 7/12 269/133
6,474,632 B1 11/2002 Liou
6,601,838 B1 8/2003 Gilley
6,928,743 B1 * 8/2005 Marshall ..... E04F 21/1855 33/648

(Continued)

*Primary Examiner* — William V Gilbert

(57) ABSTRACT

Embodiments are directed to a wood clamp that grips two perpendicularly arranged boards. A pair of gripping elements having planar surfaces may define a gripping jaw that is moveable to grip a first board A lateral support member may extend from a spacer orthogonally from a longitudinal direction of the pair of gripping elements and may define a projection. The projection may be configured to prevent sliding of a second board supported by the lateral support member and abutting the first board. A lockable handle assembly coupled with the pair of gripping elements may be configured to manipulate an offset between the pair of gripping elements by moving at least one of the pair of gripping elements and locking a position of the planar surfaces to maintain the offset using a linkage.

20 Claims, 9 Drawing Sheets

(56) References Cited

U.S. PATENT DOCUMENTS

| | | | | |
|---|---|---|---|---|
| 7,140,582 | B1 * | 11/2006 | Miller | B25B 5/068<br>248/231.41 |
| 7,168,181 | B2 * | 1/2007 | Walchak | B25B 5/068<br>269/36 |
| 7,194,937 | B1 * | 3/2007 | Melkowits | B25B 7/02<br>81/418 |
| 7,311,024 | B1 * | 12/2007 | Piel | B25B 7/02<br>81/418 |
| 7,926,394 | B1 * | 4/2011 | Gallagher | B23Q 3/06<br>269/6 |
| 2004/0169115 | A1 | 9/2004 | Glenn et al. | |

* cited by examiner

WOOD CLAMP WITH LATERAL SUPPORT MEMBER

FIELD

The described embodiments relate generally to a clamp. More specifically, the present disclosure is directed to a wood clamp for gripping two perpendicular boards.

BACKGROUND

Clamps are often used to grip various structures. Many traditional clamps secure a single structure between two gripping jaws. This may limit or prevent the clamp from gripping multiple structures.

SUMMARY

Embodiments of the present invention are directed to a wood clamp that grips two perpendicular boards.

In a first aspect, the present disclosure includes a wood clamp. The wood clamp includes a first handle. The wood clamp further includes a second handle configured to pivot relative to the first handle. The wood clamp further includes a plate coupled with the first handle. The wood clamp further includes an angled bracket coupled with the second handle and defining two perpendicular surfaces. The wood clamp further includes an arm extending from the angled bracket and along a direction that is substantially parallel to a plane defined by one of the two perpendicular surfaces of the angled bracket. The wood clamp further includes a projection extending from the arm, opposite the angled bracket, and away from the first and second handles. The plate and the angled bracket may cooperate to define a gripping jaw configured to secure a first board when the wood clamp is in a closed position. The arm may be configured to extend along a surface of a second board that is at least partially positioned between the projection and the first board.

A number of feature refinements and additional features are applicable in the first aspect and contemplated in light of the present disclosure. These feature refinements and additional features may be used individually or in any combination. As such, each of the following features that will be discussed may be, but are not required to be, used with any other feature combination of the first aspect.

For example, in an embodiment, the angled bracket may be pivotally coupled with the first and second handles. The wood clamp may further include a biasing member coupled with the angled bracket and the first handle and configured to pivot the angled bracket relative to the plate. The wood clamp may further include a linkage connected to the second handle and releasably engageable with the first handle. The wood clamp may further include a threaded member positioned at least partially within the first handle and configured to engage the linkage such that a position of the angled bracket is locked relative to a position of the plate. The wood clamp may further include a release connected to the second handle and configured to move the linkage relative to the threaded member such that the position of the angled bracket is moveable relative to the position of the plate.

In another embodiment, the plate and the angled bracket may exert a localized compression force on the first board when the wood clamp is in the closed position. The second handle may be configured to move the angled bracket away from the elongated plate to define an open position of the wood clamp. The compression force exerted on the first board may cease when the wood clamp is in the open position.

According to another embodiment, the projection may be a plate having a planar surface that faces the plate and the angled bracket. The arm may be configured to support the second board between the projection and the first board. A longitudinal direction of the first board may be transverse to a longitudinal direction of the second board. In some cases, the arm may be a cantilever structure that has a surface that is coplanar with the one of the two perpendicular surfaces of the angled bracket.

In this regard, a second aspect of the present disclosure includes a wood clamp. The wood clamp includes a pair of gripping elements having planar surfaces extending along a longitudinal direction and offset from one another. The pair of gripping elements may be moveable relative to one another to grip a first board within a gripping jaw defined by the planar surfaces. The wood clamp further includes a spacer positioned within the offset and affixed to one of the pair of gripping elements. The wood clamp further includes a lateral support member extending from the spacer orthogonally from the longitudinal direction and defining a projection. The projection may be configured to prevent sliding of a second board supported by the lateral support member and abutting the first board. The wood clamp may further include a handle assembly coupled with the pair of gripping elements and configured to: (i) manipulate the offset by moving at least one of the pair of gripping elements; and (ii) lock a position of the planar surfaces to maintain the offset using a linkage.

A number of feature refinements and additional features are applicable in the second aspect and contemplated in light of the present disclosure. These feature refinements and additional features may be used individually or in any combination. As such, each of the following features that will be discussed may be, but are not required to be, used with any other feature combination of the second aspect.

For example, in an embodiment, the handle assembly may further include a first handle affixed to a first of the pair of gripping elements. The handle assembly may further include a second handle pivotally coupled to a second of the pair of gripping elements. The linkage may be configured to releasably lock a position of the first handle relative to the second handle. The lateral support member may include an arm connected to the spacer. The projection may be positioned on the arm opposite the spacer. In some cases, the projection may extend along a direction substantially parallel with the longitudinal direction of the pair of gripping elements.

In another embodiment, the lateral support member may include a textured surface. The spacer may be a plate. The pair of gripping elements and the plate may have a common width.

In this regard, a third aspect of the present disclosure includes a wood clamp. The wood clamp includes a handle assembly comprising a set of moveable handles. The wood clamp further includes a plate affixed to a first of the set of moveable handles. The wood clamp further includes an L-shaped bracket coupled with a second of the set of moveable handles and defining: (i) a first member; and (ii) a second member affixed to the first member and extending perpendicularly from the first member and toward the plate. The wood clamp further includes a support structure cantilevered from a side of the L-shaped bracket. The handle assembly may be configured to press the L-shaped bracket toward the plate such that the wood clamp grips a first board between a planar surface of the L-shaped bracket and a planar surface of the plate. The support member may form a substantially continuous surface with the second member of the L-shaped bracket that is configured to receive a second board.

A number of feature refinements and additional features are applicable in the third aspect and contemplated in light of the present disclosure. These feature refinements and additional features may be used individually or in any combination. As such, each of the following features that will be discussed may be, but are not required to be, used with any other feature combination of the third aspect.

For example, in an embodiment, the support structure may include an arm affixed to the side of the second member. The support structure may further include a projection affixed to the arm opposite the side. In some cases, the support structure may be configured to secure the second board between the projection and the first board that is gripped between the planar surface of the L-shaped bracket and the planar surface of the plate. The planar surface of the L-shaped bracket and the planar surface of the plate may grip the first board such that the projection exerts a compression force on the second board to secure the second board within the wood clamp.

In another embodiment, the second member may be a plate having a planar surface that is substantially orthogonal to the planar surface of the first member.

In addition to the exemplary aspects and embodiments described above, further aspects and embodiments will become apparent by reference to the drawings and by study of the following description.

BRIEF DESCRIPTION OF THE DRAWINGS

The disclosure will be readily understood by the following detailed description in conjunction with the accompanying drawings, wherein like reference numerals designate like elements.

Figure 1A:
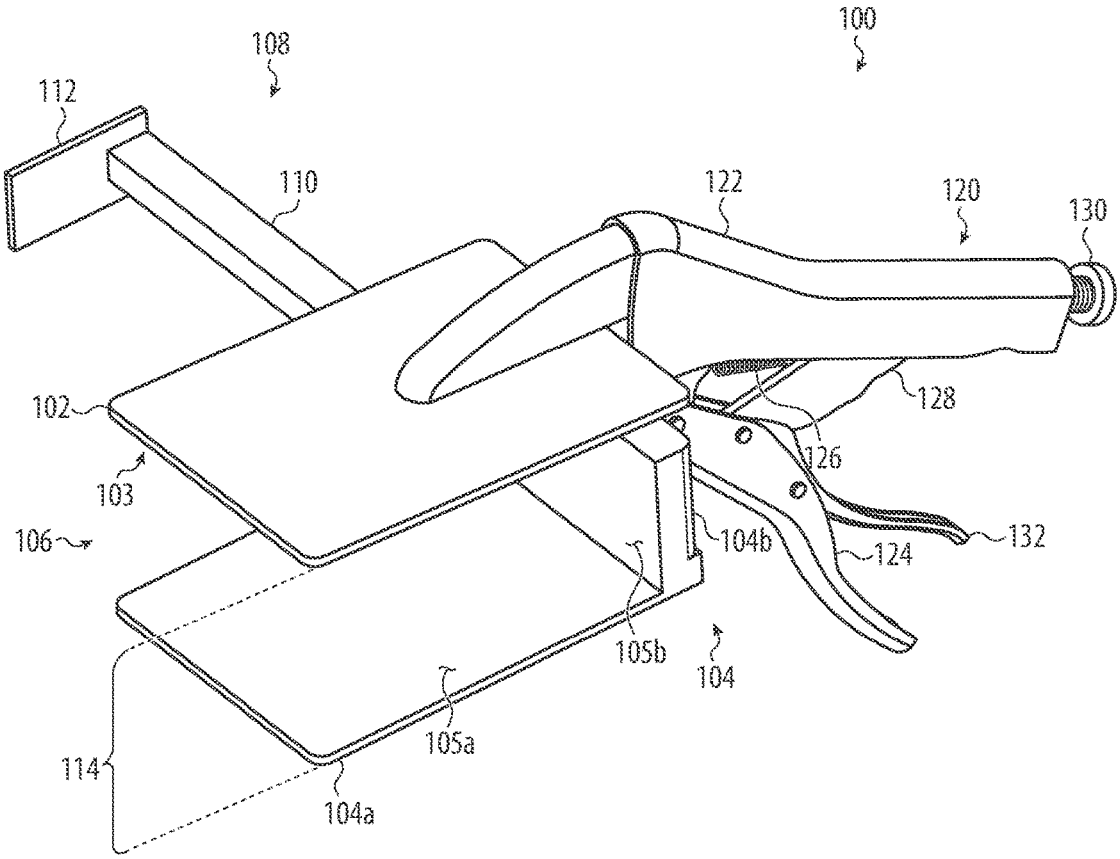
FIG. 1A depicts a top perspective view of a wood clamp in an open position.

The use of cross-hatching or shading in the accompanying figures is generally provided to clarify the boundaries between adjacent elements and also to facilitate legibility of the figures. Accordingly, neither the presence nor the absence of cross-hatching or shading conveys or indicates any preference or requirement for particular materials, material properties, element proportions, element dimensions, commonalities of similarly illustrated elements, or any other characteristic, attribute, or property for any element illustrated in the accompanying figures.

Additionally, it should be understood that the proportions and dimensions (either relative or absolute) of the various features and elements (and collections and groupings thereof) and the boundaries, separations, and positional relationships presented therebetween, are provided in the accompanying figures merely to facilitate an understanding of the various embodiments described herein and, accordingly, may not necessarily be presented or illustrated to scale, and are not intended to indicate any preference or requirement for an illustrated embodiment to the exclusion of embodiments described with reference thereto.

DETAILED DESCRIPTION

The description that follows includes sample systems, methods, and apparatuses that embody various elements of the present disclosure. However, it should be understood that the described disclosure may be practiced in a variety of forms in addition to those described herein.

When attaching or fixing a wooden member onto a roof or rafter assembly, it tends to fall off. For example, the wooden member may be arranged perpendicular to the rafter assembly and be angled with respect to a slope or grade (e.g., as shown in FIG. 5B). To maintain a position of the wooden member while permanently affixing it to the rafter assembly, one or more workers may thus hold the wooden member in place, as typical clamps may not allow the wooden member to be secured in such fashion. For example, typical wood clamps may not include multiple gripping surfaces that cooperate to secure two perpendicularly arranged wood structures.

The present disclosure describes systems, devices, and techniques related to a wood clamp configured to secure two perpendicular structures. The wood clamp may be used to temporarily grip, secure, fix, lock, or otherwise restrict movement of a first structure relative to a second structure arranged in a perpendicular configuration. In a particular embodiment, the first and second structures may be separate and distinct wooden boards that are arranged substantially perpendicular to one another. The wood clamp may be configured to grip the first and second boards while in the substantially perpendicular arrangement. This may allow a user to more permanently secure the first and second boards to one another, for example, using nails, glues, staples, or other appropriate techniques and attachment structures. The wood clamp may be subsequently released from the two perpendicularly arranged boards and repositioned relative to other boards and structures as needed. The wood clamp may be used in a variety of applications, described in greater detail below, including roofing, framing, decking, or any other appropriate use in which two structures (e.g., boards) are temporarily secured to one another in a perpendicular fashion.

The wood clamp is configured to secure or fix a position of two perpendicularly arranged boards using a set of three gripping elements. Broadly, a first and a second of the gripping elements may define a gripping jaw. The first and second gripping elements may be coupled with a lockable handle assembly that is operative to move the first and second handles to manipulate a configuration of the gripping jaw (e.g., such as to move the jaw between an open or closed configuration). The lockable handle assembly may also be configured to lock a position of the first and second gripping elements such that the gripping jaw remains in a given configuration. A first board may be positioned within the gripping jaw and secured within the wood clamp between the first and second gripping elements (e.g., the first and second gripping elements may exert a compression force on the first board that grips and fixes the position of the first board relative to the wood clamp).

A third of the gripping elements may be coupled to the first and second gripping elements by a lateral support member extending from the gripping jaw along a longitudinal axis of the first board gripped by the wood clamp. The third gripping element may be offset from, and having a major surface that is perpendicular to, one or both of a major surface of the first or second gripping elements, as described herein. A second board may be positioned within the wood clamp between the third gripping element and an end surface of the first board. The third gripping element and the end surface of the first board may exert a compression force on the second board, which may grip or fix a position of the second board relative to the first board.

In one embodiment, the first gripping element may be a plate and the second gripping element may be an angled bracket. The plate and the angled bracket may be coupled to first and second handles of the lockable handle assembly, respectively, such that the plate and the angled bracket move relative to one another in response to manipulation of the handles. The plate and angled bracket may cooperate to define a gripping jaw that is configured to grip a first board when the wood clamp is in a closed position. For example, the plate and the angled bracket may define planar gripping surfaces separated from one another by an offset. The lockable handle assembly may be configured to manipulate (and lock) the offset between the plate and the angled bracket. As described herein, the angled bracket may be defined by two perpendicular surfaces, one of which extends into the offset between the plate and the gripping surface of the angled bracket. A first board may be placed within the offset such that the plate and the perpendicular surfaces of the angled bracket extend along longitudinal surfaces of the first board. The first and second handles may subsequently be manipulated to move the plate and the angled bracket into the offset, toward the first board. This may cause the plate and the angled bracket to exert a compression force on the first board, thereby securing the first board within the wood clamp.

The wood clamp may grip a second board such that a position of the second board is fixed relative to a position of the first board within the wood clamp. In one implementation, the second board may be arranged or positioned perpendicular to the first board within the wood clamp. For example, an end surface of the first board may abut or contact a longitudinal surface of the second board. The third gripping element, described above, may be arranged on a surface of the second board opposite the end of the first board and used to maintain the position of the second board. To illustrate, the third gripping element may be a projection or plate that is affixed to the gripping jaw via an arm or other support member. The arm and projection may be a component of a lateral support member that extends away from the angled bracket and along a longitudinal direction of a first board gripped by the wood clamp. The arm may be a cantilevered structure such that one end of the arm is affixed to the angled bracket and another end of the arm is affixed to the projection. The projection may extend from the arm and along a substantially common direction of the plate and angled bracket. Accordingly, the second board may be gripped within the wood clamp by gripping the first board at a position that causes an end surface of the first board and the projection to contact the second board.

The gripping surfaces of the wood clamp may be specifically tailored to grip wooden boards, such as dimensional lumber, which may be longitudinal wooden boards or beams and that may have a nominal or standard thickness. To facilitate the foregoing, the plate, and each of the two perpendicular surfaces defined by the angled bracket, may be substantially planar surfaces. This may allow the plate and the angled bracket to define a gripping jaw that conforms or aligns with a surface of a board being gripped therebetween. In contrast to curved, concave, or otherwise non-linear contours, the substantially planar surfaces of the plate and the angled bracket may allow the wood clamp to apply a uniform or even compression force to the board such that the board does not crack, splinter, or otherwise be damaged while being secured by the wood clamp. The projection may also be a substantially planar plate or other feature that analogously applies an even or uniform distribution of force to the second board. Notwithstanding the planar contour, the surface of the gripped elements may be textured, polished, marked, painted, or otherwise appropriately finished to facilitate positioning of the two boards with the wood clamp.

Further, the gripping jaw of the wood clamp may be configured to receive dimensional lumber. For example, the plate and angled bracket (that define the gripping jaw) may define three planar surfaces that conform to or align with the planar surface of a given size of dimensional lumber when the wood clamp is in a closed position. The arm may thus be affixed to the angled bracket outside of the gripping jaw (e.g., such as along an exterior surface of the gripping jaw), rather than extend into, or from, the gripping jaw. This may allow the arm to form a substantially continuous surface with one of the perpendicular surfaces of the angled bracket. This may help maximize a gripping surface of the gripping jaw, for example, by allowing a perpendicular surface of the angled bracket and the arm to be positioned along a common longitudinal surface of a board or other dimensional lumber.

The handle assembly, as described herein, may include a set of moveable handles. The set of handles may pivot relative to one another and manipulate a position or configuration of the gripping jaw defined by the plate and the angled bracket. For example, the set of handles may cause the gripping jaw to close (e.g., the plate and the angled bracket may move toward one another) and subsequently exert a compression force on a board or other structure positioned within the gripping jaw. The handle assembly may include any appropriate components to pivot (and lock) a position of the plate and the angled bracket. As one example, the first handle may include a threaded member and the second handle may include a linkage that engages a region of the thread member. This may lock the position of the first and the second handles, and thus lock the gripping jaw in an closed position. The second handle may also include a release that may be manipulated to move the linkage away from the region of the threaded member, and thereby unlock the position of the first and second handles.

It will be appreciated that the wood clamp may be used in a variety of applications, including construction and manufacturing applications, in which it may be desirable to temporarily secure two perpendicularly arranged boards. By way of particular example, the wood clamp may be used to secure two perpendicularly arranged boards (such as a rafter board and fascia board) that are used in constructing a roof or other framing application. The rafter board may be a first board secured between the plate and the angled bracket that defines a gripping jaw of the wood clamp. The fascia board may be a second board, arranged perpendicularly with respect to the first board, that is secured within the wood clamp between the projection and an end surface of the rafter board. Because the fascia board is secured using the projection, the wood clamp may be used to secure rafter and fascia boards that are cut or constructed in a square-cut, plumb-cut, or other appropriate arrangement. For example, the projection may prevent the fascia board from falling, sliding, or otherwise detaching from the rafter board while being gripped by the wood clamp. In other cases, other applications are contemplated, including securing floor joists, wall studs, banisters, or substantially any other application, where two perpendicularly arranged boards or other structures are temporarily secured to one another.

Reference will now be made to the accompanying drawings, which assist in illustrating various features of the present disclosure. The following description is presented for purposes of illustration and description. Furthermore, the description is not intended to limit the inventive aspects to the forms disclosed herein. Consequently, variations and modifications commensurate with the following teachings, and skill and knowledge of the relevant art, are within the scope of the present inventive aspects.

FIG. 1A depicts a wood clamp 100, such as the wood clamp generally discussed above and described in greater detail below. The wood clamp 100 may be configured to grip two perpendicularly arranged boards. The wood clamp 100 may include three gripping elements or surfaces that restrict movement of each of the perpendicularly arranged boards.

In a non-limiting example, as shown in FIG. 1A, the wood clamp 100 may include a plate 102 and an angled bracket 104. The plate 102 and the angled bracket 104 may be or may form first and second gripping elements of the wood clamp 100. The plate 102 and the angled bracket 104 may cooperate to define a gripping jaw 106. The gripping jaw 106 may be used to grip a first board within the wood clamp 100. For example, the plate 102 and the angled bracket 104 may be manipulated relative to one another such that opposing longitudinal surfaces of a first board (e.g., such as first board 150 described with respect to FIG. 3) are contacted by the plate 102 and the angled bracket 104. This may grip or secure the first board within the wood clamp 100. In some cases, the plate 102 and the angled bracket 104 may exert a compression force on the first board, or other structure, positioned within the gripping jaw 106.

The wood clamp 100 may include a lateral support member 108 that extends from the angled bracket 104. The lateral support member 108 may be used to grip a second board (e.g., such as second board 152 described with respect to FIG. 3) that is positioned perpendicular to the first board 150 secured by the gripping jaw 106. The lateral support member 108 may include an arm 110 and a projection 112. The arm 110 may be a cantilevered structure that extends from the angled bracket 104 orthogonally from a longitudinal direction of the gripping jaw 106. The projection 112 may be a plate, peg, dowel, fence, post, or other structure affixed to the arm 110, opposite the angled bracket 104 and extend along a direction substantially parallel with a longitudinal direction of the gripping jaw 106. In this regard, as described in greater detail below, the second board 152 may be secured between the projection 112 and the first board 150 that is secured by the gripping jaw 106. For example, the wood clamp 100 may be manipulated such that opposing longitudinal surfaces of the second board 152 are contacted by the projection 112 and an end surface of the first board 150 secured by the gripping jaw 106. In some cases, the projection 112 and the first board 150 that is secured by the gripping jaw 106 exert a compression force on the second board 152 or otherwise holds the second board 152 in proximity to an end of the first board.

To facilitate the foregoing, the plate 102 and the angled bracket 104 may define opposing planar gripping surfaces of the gripping jaw 106 that are offset from one another. In one embodiment, the plate 102 may define a substantially planar gripping surface 103 and the angled bracket 104 may define a substantially planar gripping surface 105*a* that are separated by offset 114. The gripping surfaces 103, 105*a* may move toward one another and contact a first board 150 positioned within the gripping jaw 106 in response to manipulation of an interconnected handle assembly, described below.

As shown in FIG. 1A, the gripping surface 105*a* may be one of two perpendicular surfaces defined by the angled bracket 104. For example, the angled bracket 104 may include a first member 104*a* that defines the gripping surface 105*a* and a second member 104*b* that defines a spacer surface 105*b*. The first and second members 104*a*, 104*b* may be affixed to one another such that the gripping surface 105*a* and the spacer surface 105*b* are substantially perpendicular surfaces. The angled bracket 104 may be positioned relative to the plate 102 such that the second member 104*b* extends toward the plate 102. The spacer surface 105*b* may also be a substantially planar surface. This may allow the gripping jaw 106, as described herein, to conform or align with a contour of dimensional lumber or other wooden structure secured by the wood clamp 100. For example, the gripping surfaces 103, 105*a* and the spacer surface 105*b* may each contact a wooden structure positioned within the gripping jaw 106 when the wood clamp 100 is in a closed position.

The plate 102 and the angled bracket 104 may be separated from one another by an offset 114. The offset 114 may be manipulated to grip a structure or board within the gripping jaw 106. In a first mode or configuration, such as an open configuration, the offset 114 may be enlarged or increased (e.g., the plate 102 and the angled bracket 104 may move away from one another) to accept or allow a structure to be placed within the gripping jaw 106. In a second mode or configuration, such as a closed configuration, the offset 114 may be diminished or decreased (e.g., the plate 102 and the angled bracket 104 may more toward one another) to grip a structure within the gripping jaw 106. When the gripping jaw 106 closes, the plate 102 and the angled bracket 104 to exert a compression force on the structured positioned within the gripping jaw 106. In some cases, the wood clamp 100 may be configured to lock or maintain the offset 114, which may allow a user to more permanently secure or affix the structure secured within the gripping jaw 106 to other structures or boards secured by the wood clamp 100, such as the second board, described herein.

To facilitate the foregoing, the wood clamp 100 may include a handle assembly 120. The handle assembly 120 may be coupled with the gripping jaw 106 and configured to manipulate the offset 114. In particular, the handle assembly 120 may include a first handle 122 and a second handle 124. The first handle 122 may be coupled with the plate 102 such that movement of the first handle 122 causes corresponding movement of the plate 102. The second handle 124 may be coupled with the angled bracket 104 such that movement of the second handle 124 causes corresponding movement of the angled bracket 104. Accordingly, a user may manipulate, grip, or otherwise exert a force on one or both of the first and second handles 122, 124 and cause the offset 114 to change. For example, a user may manipulate the first and second handles 122, 124 such that the plate 102 and the angled bracket 104 move toward one another (reducing the offset 114) and exert a compression force on a first board positioned with the gripping jaw 106 such that the board is secured by the wood clamp 100.

The handle assembly 120 may include various components to facilitate the manipulation of the offset 114 and cause the gripping jaw 106 to secure the first board, as described in greater detail below with respect to FIGS. 1B and 2. For example, as shown in FIG. 1A, the handle assembly 120 may include a biasing member 126, a linkage 128, a threaded member 130, and a release 132. Broadly, the first and second handles 122, 124 may pivot relative to one another using the biasing member 126 and the linkage 128. The threaded member 130 may help lock or maintain a position of the first and second handles 122, 124 (and thus lock or maintain the offset 114), while the release is used to disengage the first and second handles 122, 124 from the locked position.

The wood clamp 100 is depicted in FIG. 1A in an open configuration. In the open configuration, the plate 102 and the angled bracket 104 may be separated from one another such that the offset 114 is at a maximum or substantially maximum value. This may allow the gripping jaw 106 to open or widen to accommodate a wooden board or other structure placed within the gripping jaw 106. As shown in FIG. 1A, the plate 102 may be separated from the second member 104*b*. Further, due in part to the pivoting of the first and second handles 122, 124 of the handle assembly 120, the angled bracket 104 may be angled or offset from the plate 102 in the open position. For example, a free end of the first member 104*a* may be positioned further away from the plate 102 than an end of the first member 104*a* affixed to the second member 104*b*. As described above, the lateral support member 108 may be affixed to the angled bracket 104. In the open configuration the lateral support member 108 may be positioned away from the plate 102 corresponding to the movements of the angled bracket 104.

The wood clamp 100 may be constructed or formed from various materials as may be appropriate for a given application. For example, the plate 102, angled bracket 104, and the lateral support member 108 may be partially, or fully, formed from metal, such as steel, including steel alloys, steels having various carbon contents, and tool steel. In other cases, other metals may be used to construct the wood clamp 100, including aluminum or aluminum alloys. However, it will be appreciated that the wood clamp 100 may be constructed of substantially any suitable material, including composite or synthetic materials.

Figure 1B:
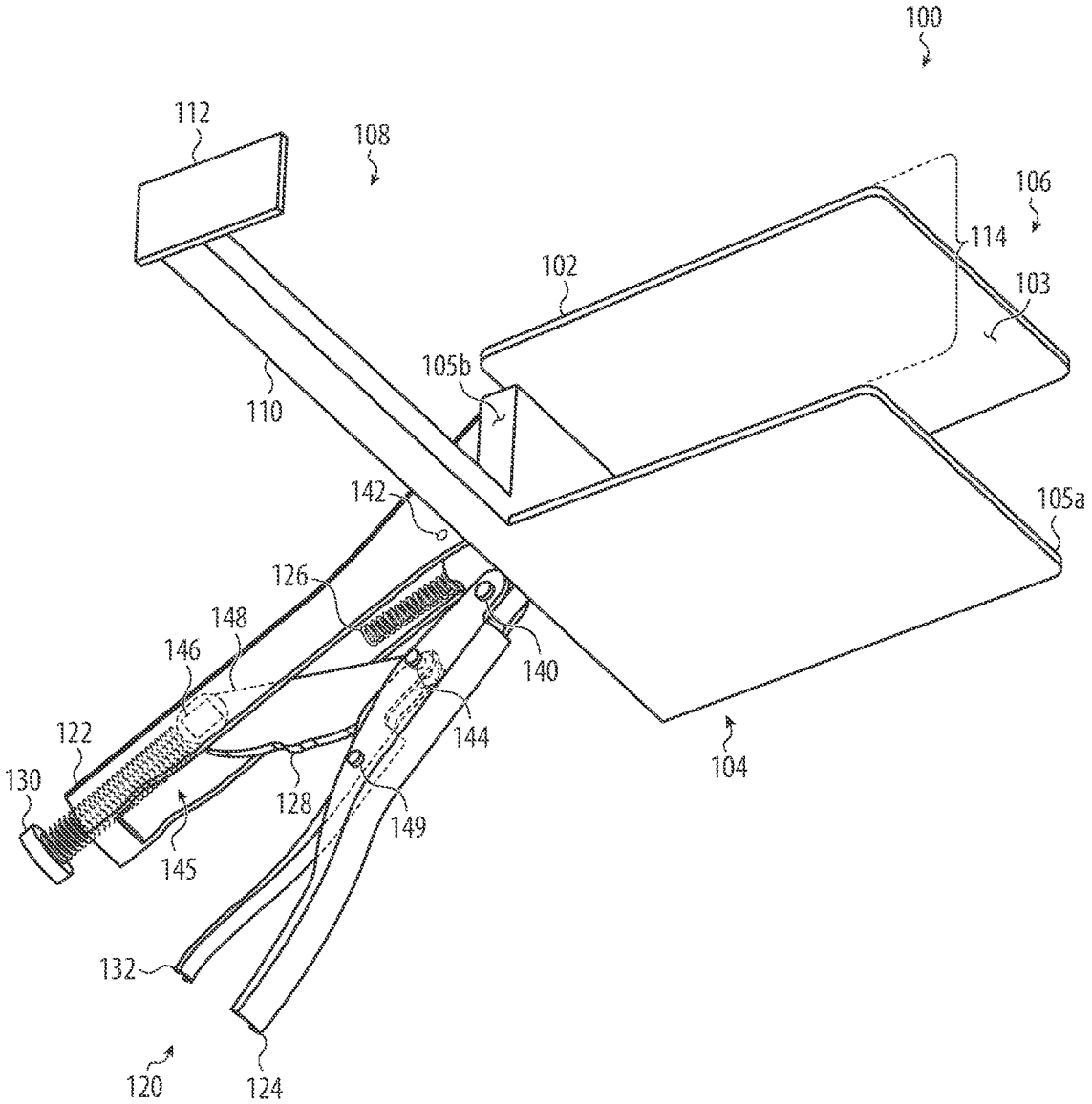
FIG. 1B depicts a bottom perspective view of the wood clamp of FIG. 1A.

FIG. 1B depicts a bottom perspective view of the wood clamp 100. As shown in FIG. 1B, the wood clamp 100 is an open configuration where the plate 102 is separated from the angled bracket 104.

The lateral support member 108 may extend from the angled bracket 104 to accommodate a wooden board, dimensional lumber, or other structure positioned within the gripping jaw 106. The lateral support member 108 may extend from the angled bracket 104 such that the arm 110 forms a common, coplanar, or otherwise continuous surface with a surface of the angled bracket 104. In the embodiment of FIG. 1B, the arm 110 is shown forming a continuous surface with the spacer surface 105*b*, however, it will be appreciated that in other embodiments, the arm 110 may extend from other surfaces of the angled bracket 104, such as forming a continuous surface with the gripping surface 105*a*. In this regard, rather than extend into the gripping jaw 106, the arm 100 is affixed to the angled bracket 104 such that the plate 102 and the angled bracket 104 may be positioned along a surface of a wooden board (e.g., the gripping surfaces 103, 105*a* and the spacer surface 105*b* may each be planar surfaces that contact surfaces of a given sample of dimensional lumber when the wood clamp 100 is in the closed position). Further, by forming a continuous surface with a surface of the angled bracket 104, the arm 110 may extend along a surface of a structure positioned within the gripping jaw 106. This may allow the lateral support member 108 to be used to secure a second, perpendicularly arranged board to the first board positioned within the gripping jaw 106.

To illustrate, the arm 110 may be a cantilever structure that extends along a surface of a first board secured by the gripping jaw 106. The arm 110 may be affixed to the projection 112 at an end of the arm 110 that is opposite the angled bracket 104. As described above, the projection 112 may be a plate, peg, dowel, fence, post, or other structure that extends along a longitudinal direction of the gripping jaw 106. The arm 110 may extend beyond an end surface of the first board positioned within the gripping jaw 106. In this regard, the projection 112 may be offset from the end surface of the first board by a gap or other spacing that may be modifiable based on a position of the first board within the gripping jaw 106 (e.g., such as gap 490 described with respect to FIG. 4). A second board may thus be positioned between the projection 112 and the end of the first board. The wood clamp 100 may secure the position of the second board relative to the position of the first board by gripping the first board within the gripping jaw 106 such that the end surface of the first board and the projection 112 contact the second board. In some cases, the projection 112 and the first board secured by the gripping jaw 106 may exert a compression force on the second board that grips or secures the second board within the wood clamp 100.

The first and second handles 122, 124 of the handle assembly 120 may be configured to cause the gripping jaw 106 to close or lock around a wooden board or other structure. In a particular embodiment, as shown in FIG. 1B, the first and second handles 122, 124 may be pivotally coupled via the angled bracket 104. For example, the angled bracket 104 may define first and second pivot nodes 140, 142. The second handle 124 may pivot or rotate relative to the angled bracket 104 about the first pivot node 140. The first handle 122 may pivot or rotate relative to the angled bracket 104 about the second pivot node 142. The first handle 122 is affixed to the plate 102. Accordingly, as the second handle 124 is moved related to the first handle 122, the angled bracket 104 may correspondingly move or pivot relative to the plate 102. The biasing member 126 may be coupled with the angled bracket 104 and the first handle 122. This may cause the biasing member 126 to exert a force on the angled bracket 104 and the first handle 122 that biases or encourages movement toward one another.

The linkage 128 and the threaded member 130 may be coupled with the first and second handles 122, 124 to facilitate locking the offset 114. To facilitate the foregoing, the second handle 124 may include a third pivot node 144. The linkage 128 may be pivotally coupled to the second handle 124 at the third pivot node 144 and extend towards, and at least partially into, a recess 145 defined by the first handle 122. The threaded member 130 may extend into the first handle 122 and partially into the recess 145. The threaded member 130 may define a series of threads or groves that may receive a corresponding series of threads or grooves contained within the recess 145. As such, the threaded member 130 may be advanced into and out of the first handle 122 by rotating the corresponding series of grooves.

The linkage 128 may engage the threaded member 130 within the recess 145 and cause the position of the first and second handles 122, 124 to consequently lock or maintain the offset 114 of the gripping jaw 106. In this regard, the threaded member 130 may include an engagement feature 146, which may be positioned within the recess 145 when the threaded member 130 is advanced into the first handle 122. The linkage 128 may define a catch 148 or other hook or similar structure that is configured to latch with the engagement feature 146. When the catch 148 of the linkage 128 latches with the engagement feature 146 of the threaded member 130, the first and second handles 122, 124 may be prevented from moving relative to one another, and thus prevent or resist variation of the offset 114. A size or magnitude of the offset 114 may therefore depend at least in part of the position of the engagement feature 146 within the recess 145. A locking size or magnitude of the offset 114 may thus be modified by advancing the threaded member 130 into and out of the recess 145.

The gripping jaw 106 may be freed from the locked position by operation of the release 132. The release 132 may be pivotally coupled to a fourth pivot node 149 at the second handle 124. The release 132 may be rotated about the fourth pivot node 149 in order to decouple the catch 148 from the engagement feature 146 and allow the first and second handles 122, 124 to move relative to one another.

Figure 2:
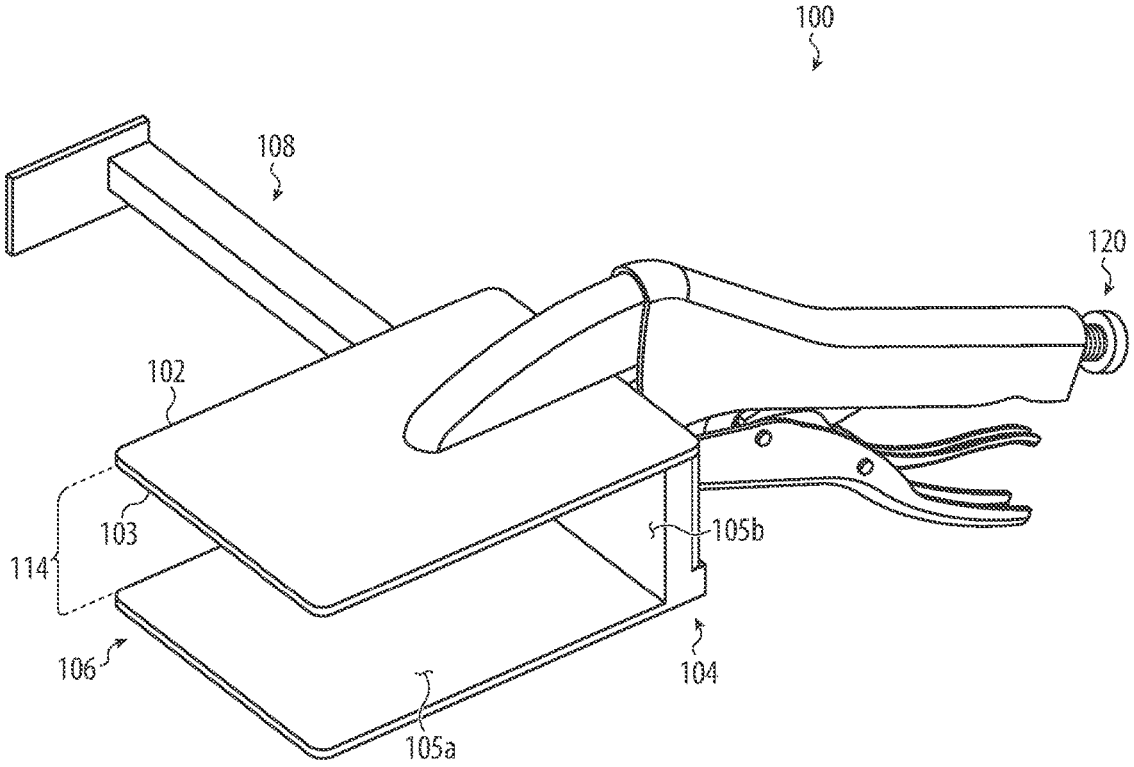
FIG. 2 depicts a top perspective view of the wood clamp of FIG. 1A in a closed position.

FIG. 2 depicts the wood clamp 100 in a closed position. In the closed position, the offset 114 between the plate 102 and the angled bracket 104 is reduced or diminished from that of the offset 114 depicted in the open position (as described with respect to FIGS. 1A and 1B). As shown in FIG. 2, in the closed position, the plate 102 and the angled bracket 104 may contact or abut one another. As such, the gripping surface 103 may contact or abut the spacer surface 105*b*. Further, the gripping surfaces 103, 105*a* may be substantially planar and parallel surfaces when the wood clamp 100 is in the closed position. The spacer surface 105*b* may thus be a perpendicular surface extending between the gripping surfaces 103, 105*a*. This configuration may allow the gripping jaw 106 to conform to a given size of dimensional lumber. For example, in the closed position, the offset 114 may be 1½ inches, 2 inches, 3 inches, 3¼ inches, or 5½ inches, however, other sizes are contemplated and within the scope of the present disclosure, including sizes less than 1½ inches and sizes greater than 5½ inches.

FIGS. 3-6 depict the wood clamp 100 in a variety of applications. As described herein, the wood clamp 100 may be used to grip two perpendicularly arranged boards in a variety of settings, including roofing, framing, decking, or any other appropriate use in which two structures are temporarily secured to one another in a perpendicular fashion. The perpendicularly arranged structures secured by the wood clamp 100 are described below with respect to dimensional lumber, beams, boards, or other wood structures. It will be appreciated that the embodiments described herein are not limited to wood. Rather, the wood clamp 100 may be used to secured a variety of structures including structures constructed from metal, metal alloys, plastics, synthetics, and/or other appropriately sized and shaped material.

Figure 3:
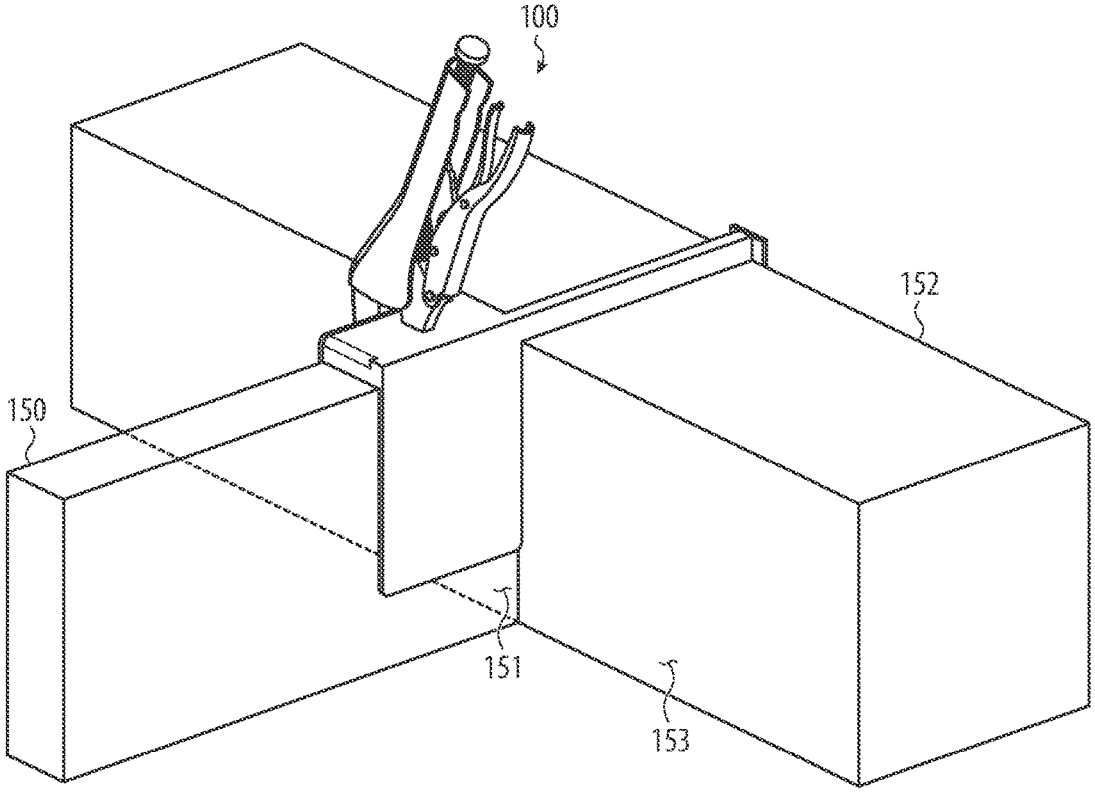
FIG. 3 depicts a wood clamp positioned along two perpendicular boards.

FIG. 3 depicts the wood clamp 100 positioned along two perpendicular boards. As shown in FIG. 3, the wood clamp 100 is positioned along a first board 150 and a second board 152. In particular, the first board 150 may be positioned within the gripping jaw 106 defined by the plate 102 and the angled bracket 104 (e.g., the first board 150 may be positioned within the offset 114 described with respect to FIGS. 1A-2). The second board 152 may be positioned between an end surface of the first board 150 and the projection 112.

As described above, the first and second handles 122, 124 of the handle assembly 120 may be manipulated to open or close a position of the gripping jaw 106 (and thus cause the wood clamp 100 to be in an open or closed configuration). In some cases, the first and second handles 122, 124 may be manipulated such that the plate 102 and the angled bracket 104 cooperate to exert a compression force on the first board 150. This may fix the position of the first board 150 within the gripping jaw 106. As shown in FIG. 3, the substantially planar surfaces of the plate 102 and the angled bracket 104 may conform to a contour of the first board 150. This may allow the gripping jaw 106 to exert a substantially uniform force on the first board 150, which may prevent the wood clamp 100 from cracking, splitting, or otherwise damaging the first board 150.

Figure 4:
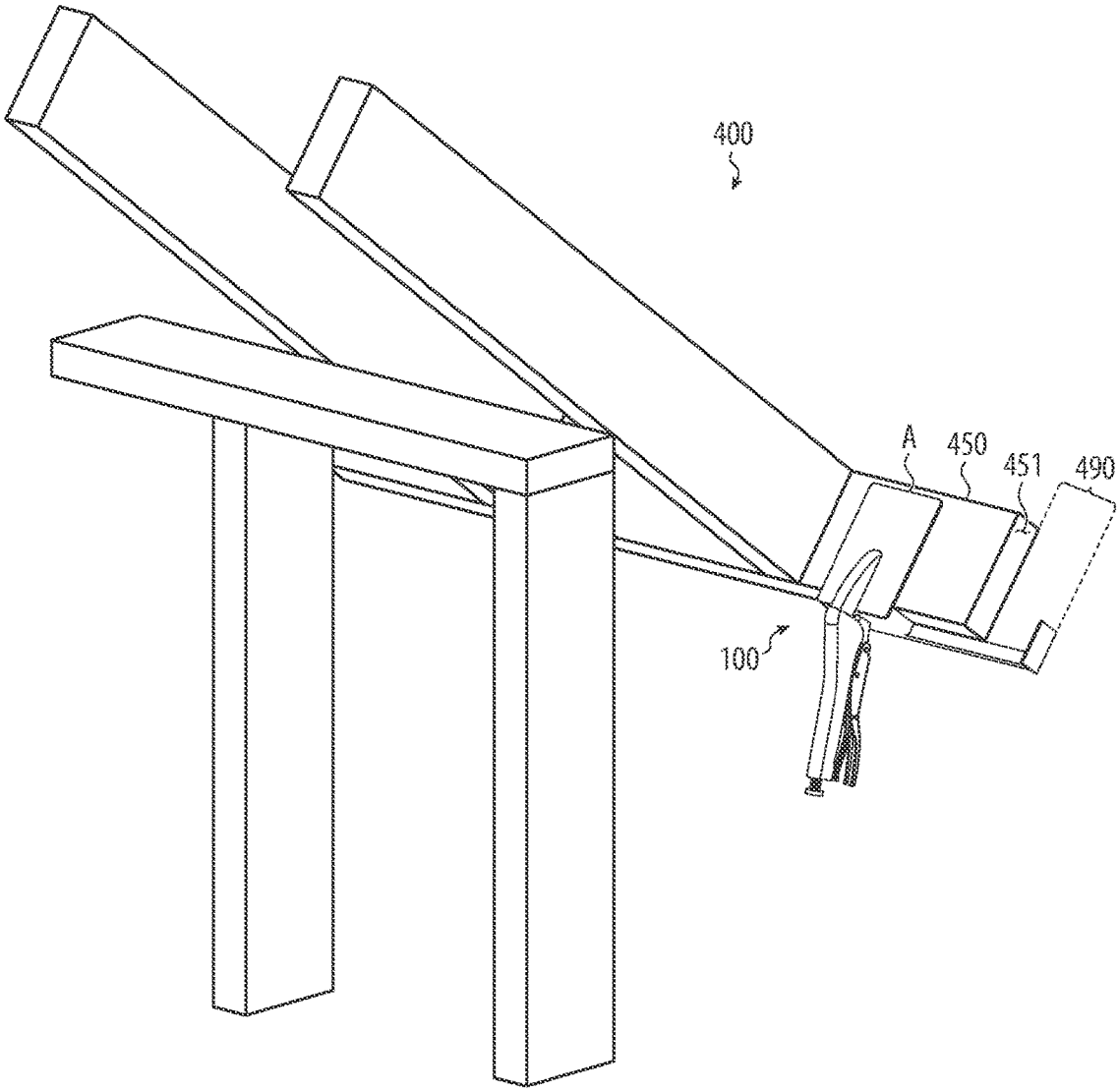
FIG. 4 depicts a wood clamp positioned on a board of a rafter assembly.

The first board 150 may be secured at a position within the gripping jaw 106 to facilitate securing the second board 152 within the wood clamp 100. For example, the first board 150 may be positioned within the gripping jaw 106 such that an end surface 151 of the first board 150 abuts or contacts a longitudinal surface 153 of the second board 152. The second board 152 may thus be gripped by the wood clamp 100 between the end surface 151 and the projection 112. Consequently, when the first board 150 is gripped within the gripping jaw 106, the second board 152 may be restricted from moving (e.g., the end surface 151 and the projection 112 may restrict movement of the second board 152 along a longitudinal direction of the first board 150). In some cases, the wood clamp 100 may grip the first board 150 such that the end surface 151 and the projection 112 cooperate to exert a compression force on the second board 152. This may restrict movement of the second board 152 along a longitudinal direction of the second board 152. rafter FIG. 4 depicts the wood clamp 100 positioned within rafter assembly 400. In particular, wood clamp 100 is depicted as having the gripping jaw 106 secured around a first board 450 at position A. At position A, the wood clamp 100 may be secured to the first board 450 to define a gap 490 between an end surface 451 of the first board 450 and the projection 112.

The wood clamp 100 may be moved (e.g., the wood clamp 100 may move laterally along the first board 450) to manipulate the gap 490. For example, as a user moves the gripping jaw 106 laterally away from the end surface 451, the gap 490 will shrink. Similarly, as the user moves the gripping jaw 106 laterally toward the end surface 451, the gap 490 will expand.

Accordingly, the wood clamp 100 may be used to grip structures of various different sizes to the first board 450. For example, a second board may be positioned perpendicularly to the first board 450 and within the gap 490. The wood clamp 100 may be moved laterally along the first board 450 so that the gap 490 conforms to a shape or dimension of the second board. In some cases, the gap 490 may be further reduced such that the end surface 451 and the projection 112 exert a compression force on the second board to restrict movement of the second board relative to the perpendicularly arranged first board 450.

Figure 5A:
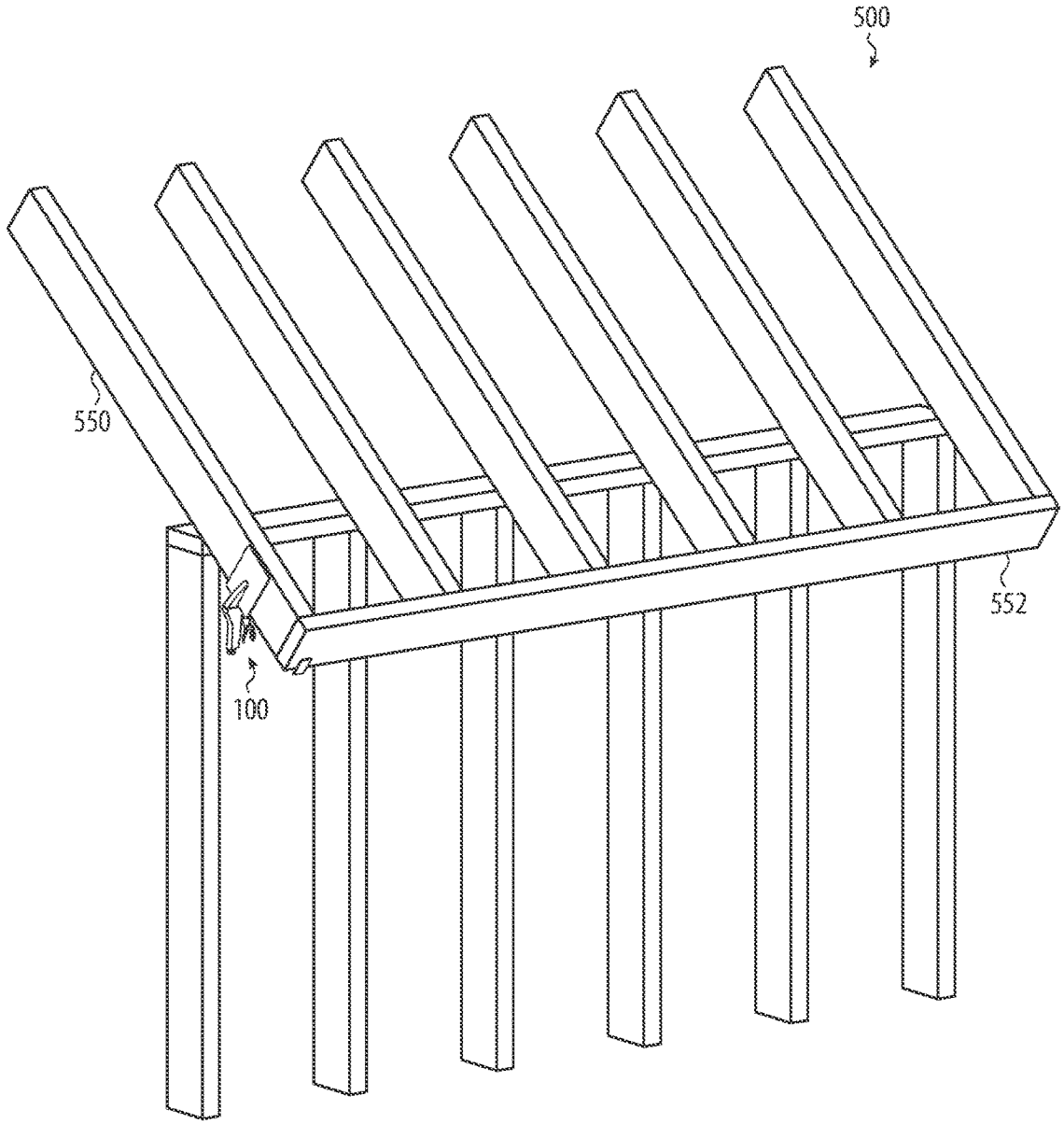
FIG. 5A depicts a wood clamp positioned along two boards of a square-cut rafter assembly.
Figure 5B:
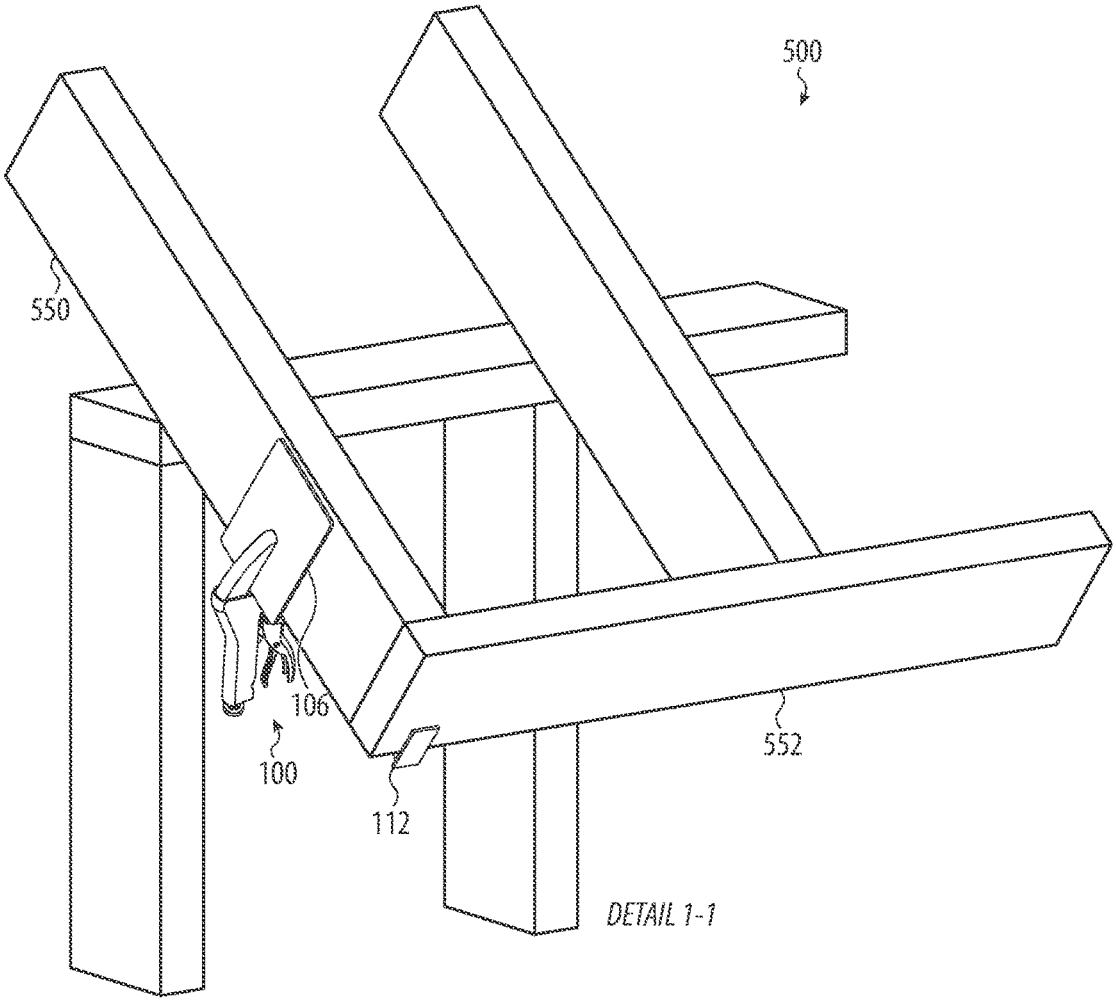
FIG. 5B depicts an enlarged view of the wood clamp of FIG. 5A.

FIG. 5A depicts the wood clamp 100 positioned with a rafter assembly 500. The rafters assembly 500 may include a series of wooden members arranged in a "square-cut" configuration. For example, the rafter assembly 500 may include a one or more wooden members, such as first wooden member 550, and a second wooden member 552. In one embodiment, the wood clamp 100 may fix the position of the second wooden member 552 relative to a position of the first wooden member 550. This may allow a user to more permanently secure the second wooden member 552 to the first wooden member 550 within the rafter assembly 500.

By way of particular illustration, the first wooden member 550 may be one of a set of substantially evenly spaced wooden members that that define a support structure for a roof. The first wooden member 550 may extend angularly within the rafter assembly 500 such that an end surface of the wooden member is angled with respect to a slope or grade of a structure over which the roof is formed. The second wooden member 552 may be an elongated structure that extends along a lower edge of the roof.

In the square-cut configuration, as shown in FIG. 5A, the first wooden member 550 may be formed from dimensional lumber and define an end surface that is substantially transverse to both longitudinal surfaces of the rafter (e.g., the end surface is not cut, chamfered, or the like). In this regard, when the second wooden member 552 is positioned along the end surface of the first wooden member 550, the second wooden member 552 may be angled with respect to the slope or grade of the structure (e.g., due to the first wooden member 550 being angled with the rafter assembly 500). This may be beneficial for managing drainage and water runoff from a roofing surface defined above the first wooden member 550.

Notwithstanding the angular orientation of the first wooden member 550 and the second wooden member 552, the wood clamp 100 may be configured to grip the first wooden member 550 and the second wooden member 552 when positioned in a perpendicular arrangement. For example, the gripping jaw 106 may be positioned around the first wooden member 550. As described above, the handle assembly 120 may be manipulated such that gripping jaw 106 exerts a compression force on the first wooden member 550; this may grip the first wooden member 550 within the wood clamp 100. The wood clamp 100 may grip the first wooden member 550 such that the arm 110 of the lateral support member 108 extends along a longitudinal surface of the first wooden member 550 and the projection 112 is positioned offset from an end surface of the first wooden member 550. In this regard, the second wooden member 552 may be positioned between the first wooden member 550 and the projection 112. This may allow the wood clamp 100 to grip the second wooden member 552 and secure the second wooden member 552 relative to the first rafter 550. For example, the wood clamp 100 may be affixed to the first wooden member 550 such that the end surface of the first wooden member 550 and the projection 112 exert a compression force on the second wooden member 552. The projection 112 therefore prevents the second wooden member 552 from falling or sliding relative to the rafter assembly 500.

FIG. 5B depicts detail 1-1 of FIG. 5A of the wood clamp 100 positioned within the rafter assembly 500.

Figure 6A:
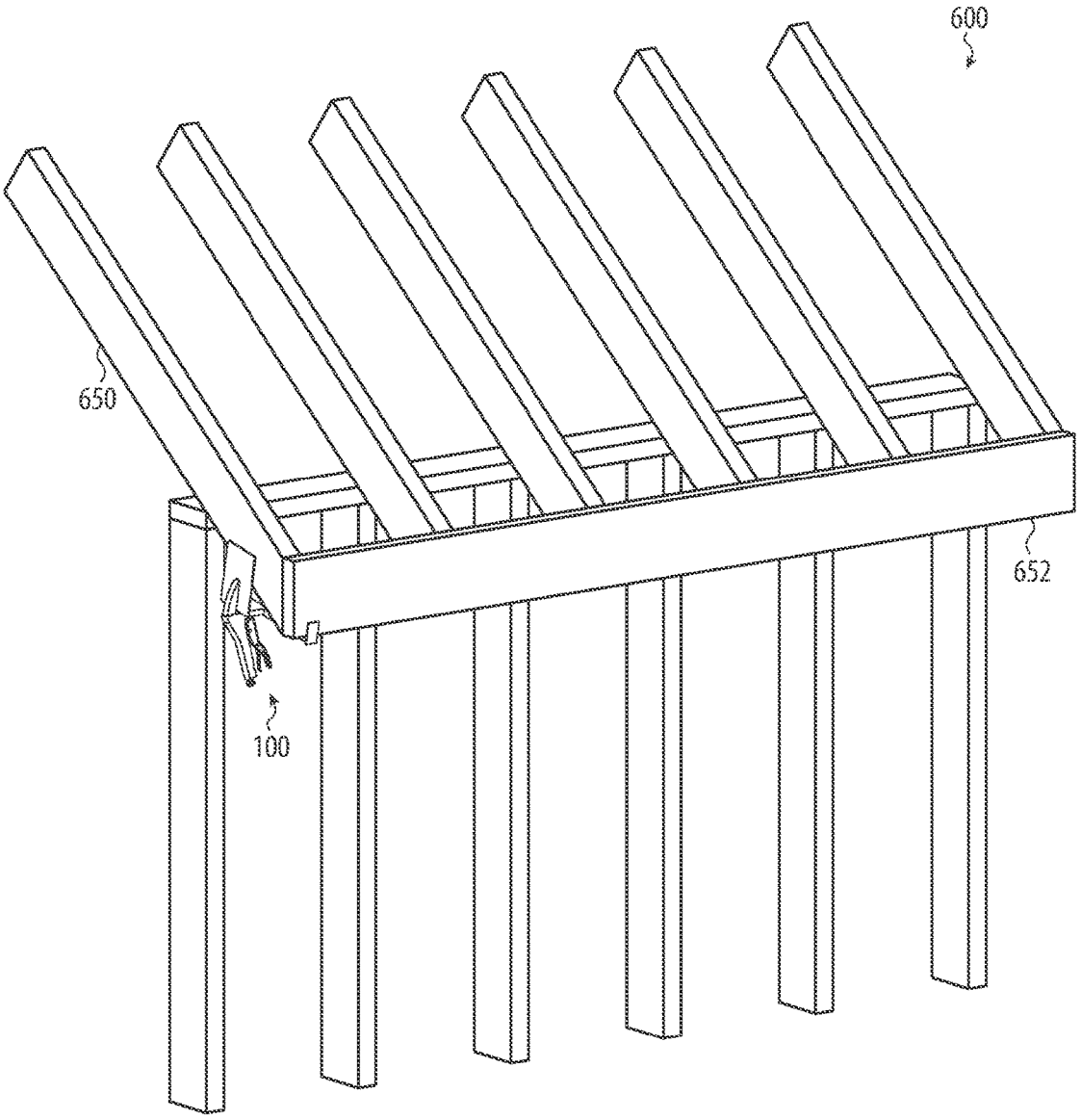
FIG. 6A depicts a wood clamp positioned along two boards of a plumb-cut rafter assembly.

FIG. 6A depicts the wood clamp 100 positioned with a rafter assembly 600. The rafter assembly 600 may include a series of wooden members arranged in a "plumb-cut" configuration. For example, the rafter assembly 600 may include a one or more wooden members, such as a first wooden member 650, and a second wooden member 652. In one embodiment, the wood clamp 100 may fix the position of the second wooden member 652 relative to a position of the first wooden member 650. This may allow a user to more permanently secure the second wooden member 652 to the first wooden member 650 within the rafter assembly 600.

By way of particular illustration, substantially analogous to the first wooden member 550 and second wooden member 552 described above with respect to FIGS. 5A and 5B, the first wooden member 650 may be one of a set of substantially evenly spaced wooden members that that define a support structure for a roof. The first wooden member 650 may extend angularly within the rafter assembly 600 such that an end surface of the first wooden member 650 is angled with respect to a slope or grade of a structure over which the roof is formed. The second wooden member 652 may be an elongated structure that extends along a lower edge of the roof.

In the plumb-cut configuration, as shown in FIG. 6A, the first wooden member 650 may be formed from dimensional lumber and define an end surface that is trimmed, cut, chambered or the like such that an end surface of the rafter board may be substantially perpendicular with a grade or slope of the structure. In this regard, when the second wooden member 652 is position along the end surface of the first wooden member 650, the second wooden member 652 may, too, be substantially perpendicular with respect to the slope or grade of the structure. This may be beneficial for aesthetic or other construction considerations.

Notwithstanding the angular orientation of the first wooden member 650 and the second wooden member 652, the wood clamp 100 may be configured to grip the first wooden member 650 and the second wooden member 652 when positioned in a perpendicular arrangement. For example, the gripping jaw 106 may be positioned around the first wooden member 650. As described above, the handle assembly 120 may be manipulated such that gripping jaw 106 exerts a compression force on the first wooden member 650; this may grip the first wooden member 650 within the wood clamp 100. The wood clamp 100 may grip the first wooden member 650 such that the arm 110 of the lateral support member 108 extends along a longitudinal surface of the first wooden member 650 and the projection 112 is positioned offset from an end surface of the first wooden member 650. In this regard, the second wooden member 652 may be positioned between the first wooden member 650 and the projection 112. This may allow the wood clamp 100 to grip the second wooden member 652 relative to the first wooden member 650. For example, the wood clamp 100 may be affixed to the first wooden member 650 such that the end surface of the first wooden member 650 and the projection 112 exert a compression force on the second wooden member 652. The projection 112 therefore prevents the second wooden member 652 from falling or sliding relative to the rafter assembly 600.

Figure 6B:
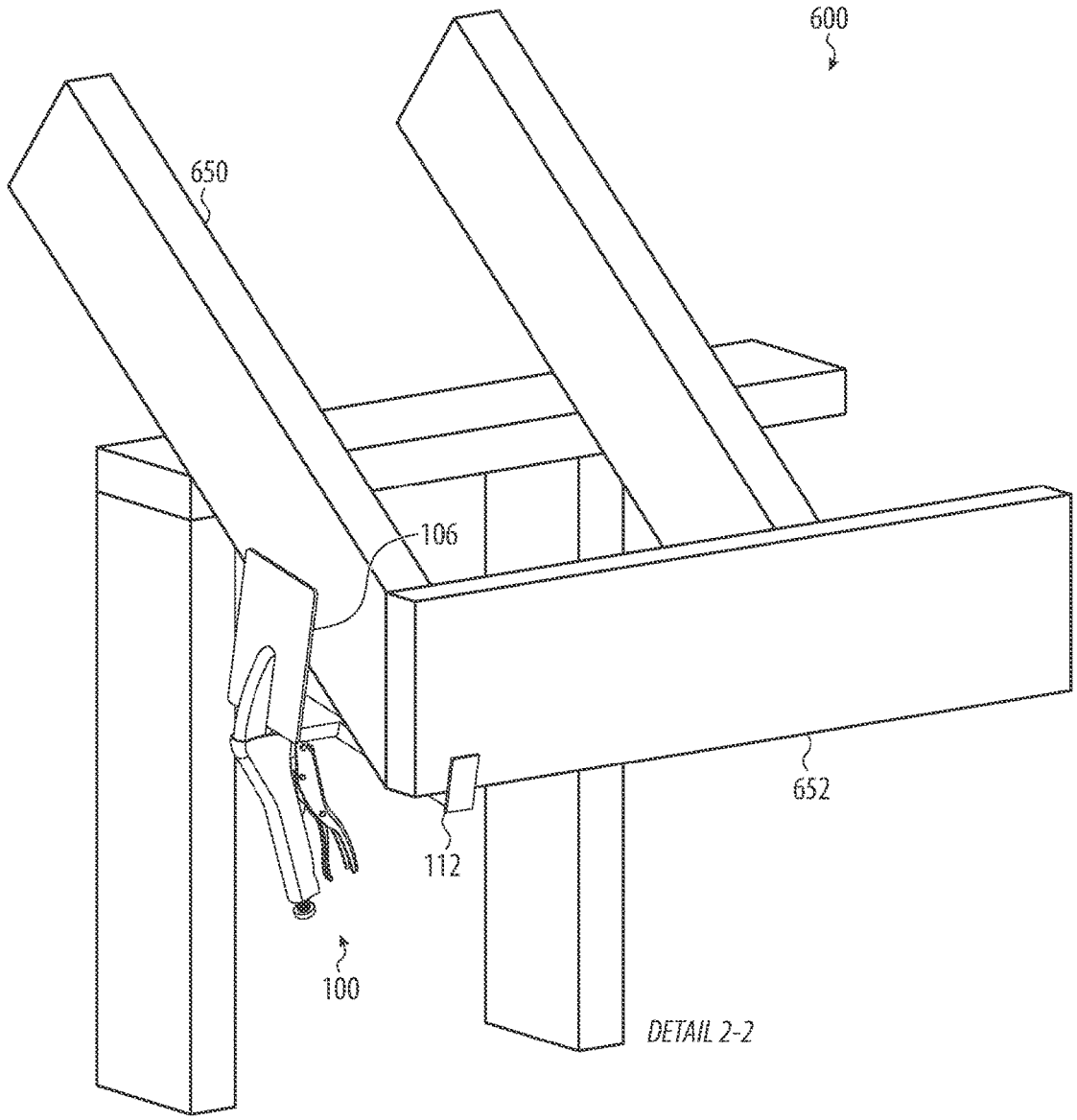
FIG. 6B depicts an enlarged view of the wood clamp of FIG. 6A.

FIG. 6B depicts detail 2-2 of FIG. 6A of the wood clamp 100 positioned within the rafter assembly 600.

Other examples and implementations are within the scope and spirit of the disclosure and appended claims. For example, features implementing functions may also be physically located at various positions, including being distributed such that portions of functions are implemented at different physical locations. Also, as used herein, including in the claims, "or" as used in a list of items prefaced by "at least one of" indicates a disjunctive list such that, for example, a list of "at least one of A, B, or C" means A or B or C or AB or AC or BC or ABC (i.e., A and B and C). Further, the term "exemplary" does not mean that the described example is preferred or better than other examples.

The foregoing description, for purposes of explanation, uses specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A wood clamp, comprising:

a first handle;

a second handle, the first and second handles configured to pivot relative to one another;

a plate coupled with the first handle;

an angled bracket coupled with the second handle and defining two perpendicular surfaces;

an arm extending from the angled bracket and along a direction that is substantially parallel to a plane defined by one of the two perpendicular surfaces of the angled bracket and to a plane defined by the other of the two perpendicular surfaces of the angled bracket; and a projection extending from the arm, wherein:

the plate and the angled bracket cooperate to define a gripping jaw configured to secure a first board when the wood clamp is in a closed position, the plate and a surface of the angled bracket being parallel when the gripping jaw is in the closed position; and the arm is configured to extend along a surface of a second board that is perpendicular to the first board and that is at least partially positioned between the projection and the first board.

2. The wood clamp of claim 1, wherein, the angled bracket is pivotally coupled with the first and second handles; and the wood clamp further comprises:

a biasing member coupled with the angled bracket and the first handle and configured to pivot the angled bracket relative to the plate; and a linkage connected to the second handle and releasably engageable with the first handle.

3. The wood clamp of claim 2, further comprising:

a threaded member positioned at least partially within the first handle and configured to engage the linkage such that a position of the angled bracket is locked relative to a position of the plate; and a release connected to the second handle and configured to move the linkage relative to the threaded member such that the position of the angled bracket is moveable relative to the position of the plate.

4. The wood clamp of claim 1, wherein the plate and the angled bracket exert a localized compression force on the first board when the wood clamp is in the closed position.

5. The wood clamp of claim 4, wherein:

the second handle is configured to move the angled bracket away from an elongated plate to define an open position of the wood clamp; and the localized compression force exerted on the first board ceases when the wood clamp is in the open position.

6. The wood clamp of claim 1, wherein the projection is a plate having a planar surface that faces the plate and the angled bracket.

7. The wood clamp of claim 1, wherein:

the arm is configured to support the second board between the projection and the first board; and a longitudinal direction of the first board is transverse to a longitudinal direction of the second board.

8. The wood clamp of claim 7, wherein the arm is a cantilever structure that has a surface that is coplanar with the one of the two perpendicular surfaces of the angled bracket.

9. A wood clamp, comprising:

a pair of gripping elements having planar surfaces extending along a longitudinal direction and having an offset from one another, the pair of gripping elements moveable relative to one another and configured to exert a compression force in a direction orthogonal to the longitudinal direction;

a spacer positioned within the offset and affixed to one of the pair of gripping elements;

a lateral support member extending from the spacer orthogonally from the longitudinal direction and orthogonally from the compression force direction, the lateral support member comprising a projection; and a handle assembly coupled with the pair of gripping elements and configured to:

manipulate the offset by moving at least one of the pair of gripping elements; and lock a position of the planar surfaces, using a linkage, to maintain the offset.

10. The wood clamp of claim 9, wherein the handle assembly comprises:

a first handle affixed to a first of the pair of gripping elements; and a second handle pivotally coupled to a second of the pair of gripping elements; and wherein the linkage is configured to releasably lock a position of the first handle relative to the second handle.

11. The wood clamp of claim 9, wherein:

the lateral support member comprises an arm connected to the spacer; and the projection is positioned on the arm opposite the spacer.

12. The wood clamp of claim 11, wherein the projection extends from the lateral support member along a direction substantially parallel with the longitudinal direction of the pair of gripping elements.

13. The wood clamp of claim 9, wherein the lateral support member includes a textured surface.

14. The wood clamp of claim 9, wherein the gripping jaw is configured to exert a compression force to grip a first board, wherein the spacer comprises a plate configured to conform to a size of the first board, and wherein the projection is configured to prevent lateral sliding of a second board supported by the lateral support member and abutting the first board, wherein lateral is defined with respect to the longitudinal direction.

15. The wood clamp of claim 14, wherein the width of each of the pair of gripping elements and the width of the plate are the same.

16. A wood clamp, comprising:

a handle assembly comprising a set of moveable handles;

a plate affixed to a first of the set of moveable handles;

an L-shaped bracket coupled with a second of the set of moveable handles and comprising:

a first member having a planar surface; and a second member affixed to the first member and extending perpendicularly from the first member and toward the plate; and a support structure cantilevered from a side of the L-shaped bracket so that the support structure moves with the L-shaped bracket, wherein:

the handle assembly is configured to press the L-shaped bracket toward the plate such that the wood clamp grips a board between a planar surface of the L-shaped bracket and a planar surface of the plate; and the support structure forms a substantially continuous surface with the second member of the L-shaped bracket that is also pressed toward the plate as the wood clamp grips the board.

17. The wood clamp of claim 16, wherein the support structure comprises:

an arm affixed to a side of the second member; and a projection affixed to the arm opposite the side.

18. The wood clamp of claim 17, wherein the support structure is configured to secure the second board between the projection and the first board that is gripped between the planar surface of the L-shaped bracket and the planar surface of the plate.

19. The wood clamp of claim 18, wherein the planar surface of the L-shaped bracket and the planar surface of the plate grip the first board such that the projection exerts a compression force on the second board to secure the second board within the wood clamp.

20. The wood clamp of claim 16, wherein the second member is a plate having a planar surface that is substantially orthogonal to the planar surface of the first member.

* * * * *